US006758416B2

(12) United States Patent
Earhart et al.

(10) Patent No.: US 6,758,416 B2
(45) Date of Patent: Jul. 6, 2004

(54) FUEL INJECTOR HAVING AN EXPANSION TANK ACCUMULATOR

(75) Inventors: Thomas Earhart, Middleville, MI (US); Mike Van Allsburg, Dorr, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/231,742

(22) Filed: Aug. 30, 2002

(65) Prior Publication Data

US 2004/0046058 A1 Mar. 11, 2004

(51) Int. Cl.[7] ..... F02M 63/00
(52) U.S. Cl. ..... 239/533.2; 123/467
(58) Field of Search ..... 239/88–91, 533.1–533.5, 239/585.1–585.5; 123/467

(56) References Cited

U.S. PATENT DOCUMENTS

| | | | | |
|---|---|---|---|---|
| 3,639,085 A | | 2/1972 | Bertsch et al. | |
| 3,683,751 A | | 8/1972 | Eickmann | |
| 4,451,213 A | | 5/1984 | Takei et al. | |
| 5,228,844 A | * | 7/1993 | Klopfer et al. | 417/440 |
| 5,757,259 A | * | 5/1998 | Fulford et al. | 336/92 |
| 5,782,411 A | | 7/1998 | Potter | |
| 5,926,082 A | * | 7/1999 | Coleman et al. | 335/260 |
| 6,009,858 A | | 1/2000 | Teerman | |
| 6,020,664 A | | 2/2000 | Liu et al. | |
| 6,140,725 A | | 10/2000 | Jensen et al. | |
| 6,247,450 B1 | * | 6/2001 | Jiang | 123/446 |

* cited by examiner

*Primary Examiner*—Michael Mar
*Assistant Examiner*—Thach H Bui
(74) *Attorney, Agent, or Firm*—Brooks Kushman P.C.

(57) ABSTRACT

An electromechanical fuel injector for an internal combustion engine. The fuel injector includes a pump unit and a control valve assembly in communication with the pump unit. The control valve assembly including a body and a stator. The fuel injector also includes a stator nut cooperable with the valve body to secure the stator to the valve body and at least one expansion tank to accumulate pressure created by the pump unit. The fuel injector may also include a spacer.

16 Claims, 3 Drawing Sheets

FUEL INJECTOR HAVING AN EXPANSION TANK ACCUMULATOR

BACKGROUND OF THE INVENTION

1. Field of the Invention

The invention relates to fuel injectors for internal combustion engines and, in particular, to a fuel injector having a stator nut used as an accumulator.

2. Background Art

It is known practice to use fuel injectors for internal combustion engines, particularly for each cylinder of multi-cylinder engines. The injector includes an injector needle valve assembly that receives pressurized fluid from a fuel injector pump. The pump in turn is driven by the engine camshaft. Fuel injection pulses are delivered to the combustion camber of the internal combustion engine. The camshaft, which is driven at one-half engine speed, develops a pressure pulse during the injection phase of the four-stroke engine cycle.

A fuel injection plunger is driven by a cam surface on the engine camshaft. The plunger and its associated fuel cylinder define a fuel pumping chamber. The fuel supply for a control valve assembly is a low pressure fuel pump that circulates fluid through the control valve at intervals in the engine cycle when the control valve is in an open position. A low pressure fuel passageway directs fuel from the control valve to the fuel pumping chamber. When the valve is in a closed position, direct fluid communication between the fuel pump and the fuel pressure chamber is interrupted as the plunger is stroked during a fuel injection event. The stroked plunger creates a high injection pressure in a nozzle fuel supply passageway. The timing of the opening and the closure of the control valve is controlled by a solenoid actuator under the control of an electronic engine control system.

The fuel pressure chamber communicates with an injection nozzle orifice valve that registers with an injection orifice. Pressure developed in the fuel pressure chamber acts on a differential area on the needle valve to shift the needle valve to an open position during the injection event. Movement of the needle valve under pressure is opposed by a needle valve spring that normally tends to keep the needle valve closed.

The needle valve spring is situated in a spring cage, which forms a part of the fuel injection assembly. The needle valve has a stem that defines a guide surface.

SUMMARY OF THE INVENTION

The present invention discloses an electromechanical fuel injector for an internal combustion engine. The fuel injector includes a pump unit and a control valve assembly in communication with the pump unit. The control valve assembly includes a body and a stator. The fuel injector also includes a stator nut cooperable with the valve body to secure the stator to the valve body, and at least one expansion tank to accumulate pressure created by the pump unit. The fuel injector may also include a spacer positioned between the stator and the valve body to create a passageway to expansion tanks located between the stator and stator nut.

The down stroke of the plunger creates high injection pressure in the fuel passageway. When the valve element opens to end the injection of fuel, the built up pressure is communicated to the stator and the armature cavity. In known injectors, this may cause fuel to leaks, which can cause failure of the stator and related actuator components.

The present invention avoids this problem by providing expansion tanks that accumulate pressure created by the down stroke of the plunger. This reduces the armature cavity pressure, thereby extending the useful life of the fuel injector.

The above features of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
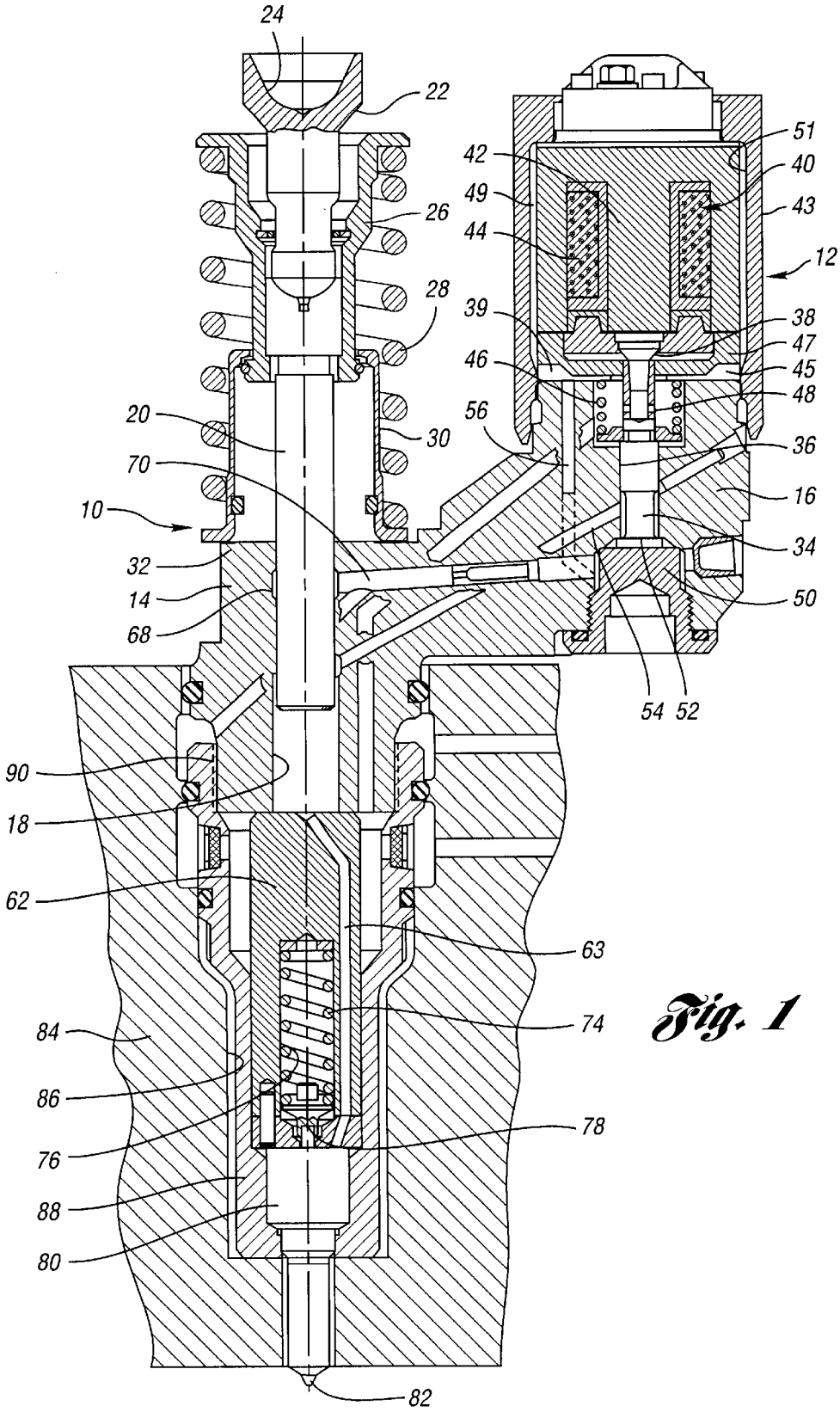
FIG. 1 is a cross sectional view of an injector incorporating the present invention.
Figure 2:
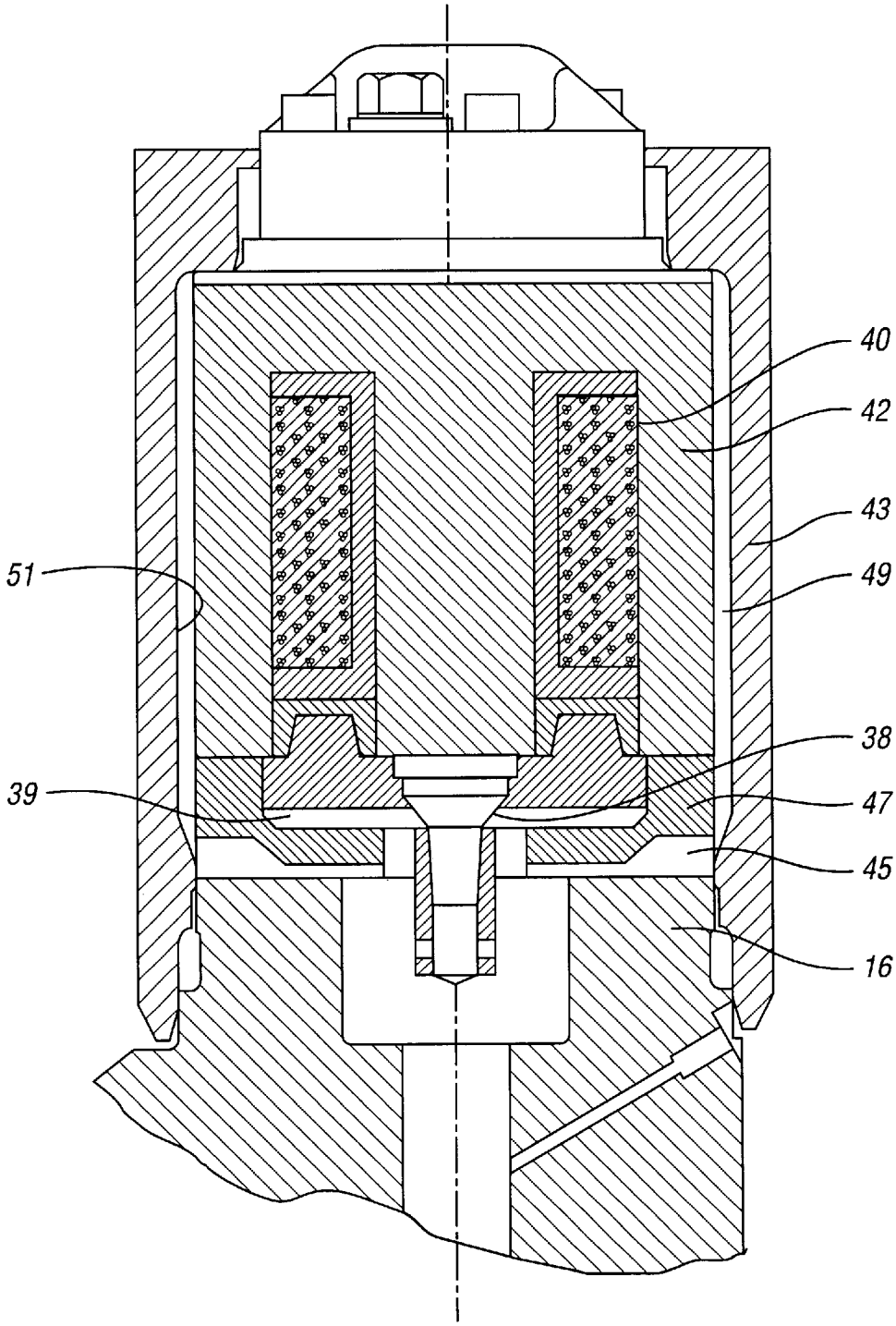
FIG. 2 is a cross sectional detailed view of the control valve assembly incorporating the present invention.

A fuel injector according to the present invention is shown in FIGS. 1 and 2. It comprises a pump unit 10 and a control valve assembly 12. The pump unit may comprise a pump housing or body 14 that is integral with or that forms a part of a housing or valve body 16 for the control valve assembly.

The pump housing or body 14 is provided with a cylinder 18 which receives a plunger 20. Cylinder 18 and plunger 20 define a high pressure pumping chamber. The upper end of the plunger 20 includes a cam follower 22 having a bearing pocket 24, which receives an actuator lever driven by the engine camshaft (not shown).

A spring retainer 26 surrounds follower 22 and moves together with the follower 22 against the opposing force of a follower spring 28. The lower end of the spring 28 surrounds the guide element 30, which is seated on a shoulder 32 on the pump body 14.

Spring cage 62 forms a part of a nozzle assembly, which includes a needle valve spring 74 located in spring chamber 76 formed in the cage 62 and a high pressure fuel delivery passage 63 for the nozzle assembly. The spring 76 engages the top of needle valve **78*n* received in a needle valve opening formed in nozzle assembly housing 80. The needle valve opens and closes nozzle orifices at nozzle tip 82 situated in the fuel combustion chamber. The cylinder head 84 for the engine has recesses 86** that receive the injector.

The nozzle assembly housing 80 is received in a nozzle nut 88 which, in turn, is received in the opening 86. The nozzle nut is threadedly connected at 90 to the cylinder body 14.

The fuel injector injects fuel into the engine cylinder in a known manner.

The valve assembly comprises a valve spool element 34 with a guide surface located in a valve opening 36. Valve element 34 is connected to an armature 38 of an electromagnetic actuator 40. The actuator 40 includes a stator 42 and an actuator coil 44. The stator includes molding material and magnetic material. A stator nut 43 secures the stator to the valve body 16. Preferably, the stator nut 43 is threadedly received onto the valve body 16. When the coil is energized, armature 38 engages the end face of the stator 42. This closes the valve element 34.

The valve element 34 is shifted toward an open position by valve spring 46 situated in spring chamber 48 in the body 16. When the valve element is shifted to the open position, its motion is limited by a control valve stop 50 threadedly received in an opening in body 16.

The lower end of the valve element 34 is provided with an annular sealing shoulder 52. When the actuator is energized, the shoulder 52 sealingly engages a valve seat formed in the body 16, which surrounds the valve chamber 36. The valve will seal a high pressure fuel passage 54 from a low pressure opening occupied by the control valve stop 50. That low pressure opening communicates spring chamber 48 with the armature cavity 39. That communication is established via a low pressure fuel passage 56.

In conventional fuel injectors, the down stroke of the plunger 20 creates high injection pressure in the fuel passage 54. When the valve element 34 opens to end the injection of fuel, the built up fuel pressure is communicated to the stator 42 and the armature cavity 39 via passage 56, which may lead to fuel leaks and failure of the stator, actuator, and related components by, for example, causing separation of the molding material and magnetic material.

The present invention comprises at least one expansion tank, which comprises a pressure accumulator space communicating with passage 54 to accumulate the pressure and reduce the effects of the pressure on the stator 42 and other components. A spacer 47 is positioned between the armature 38 and the valve body 16. The spacer 47 creates a first expansion tank 45 between the valve body 16 and the spacer. The spacer may be slotted to create expansion tank volume or act as a passageway. Alternatively, the spacer 47 may be porous.

Further reduction in the armature cavity pressure can be accomplished by increasing the capacity of the expansion tank. Larger spacers 47 could be used. However, a more efficient technique involves creating expansion tanks between the stator 42 and the stator nut 43. Grooves 51 can be added to either or both the inside surface of the stator nut 43 or the outside surface of the stator 42 to create a second expansion tank 49. Alternatively, the exterior diameter of the stator 42 could be reduced locally or in general, or the interior diameter of the stator nut 43 could be increased to enlarge the volume of the second expansion tank 49. The volume of the second expansion tank 49 also could be increased using other techniques such as by forming flat spots on the stator 42.

Figure 3:
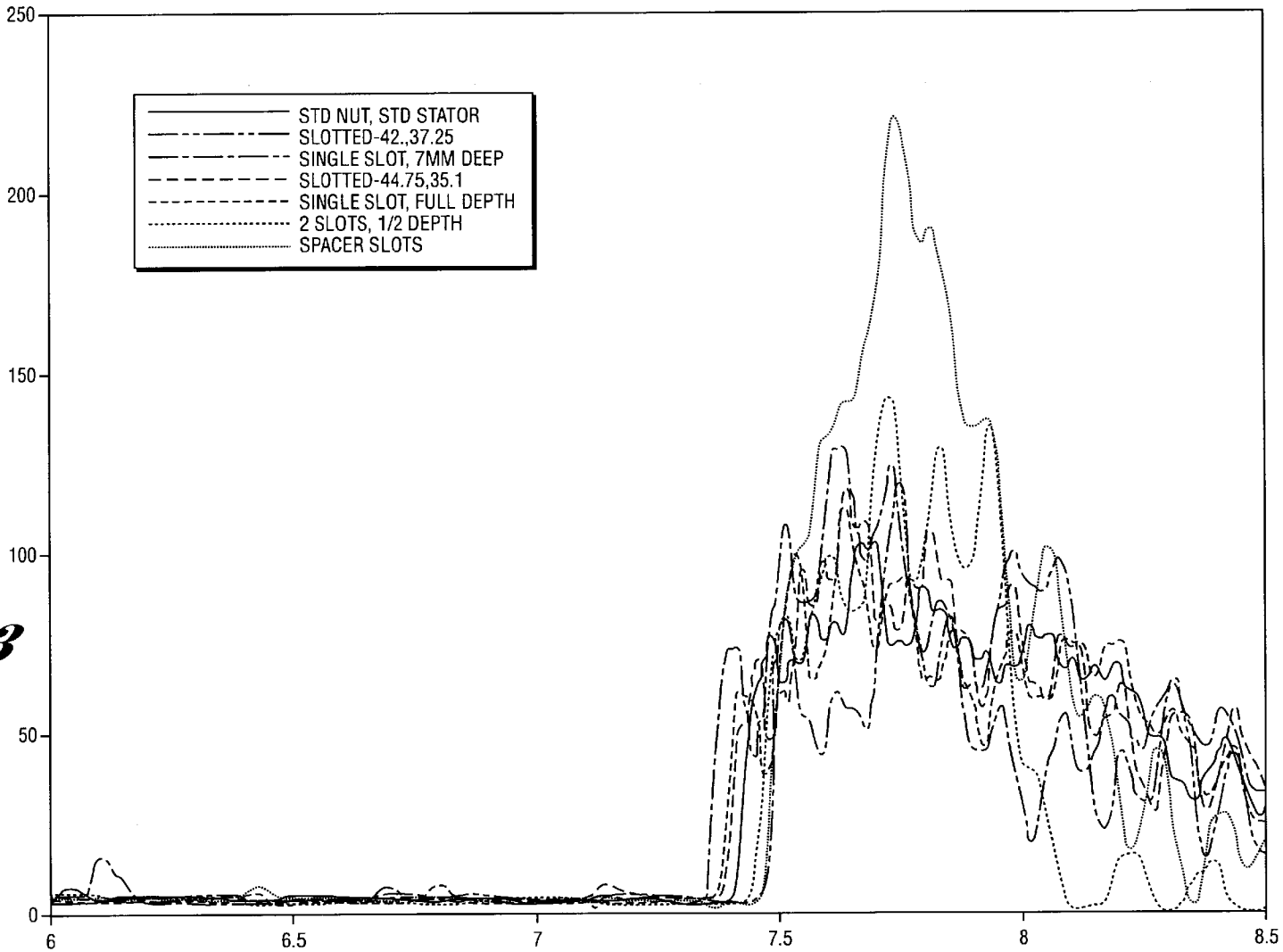
FIG. 3 is a graph illustrating the armature cavity pressure for various expansion tank configurations.

FIG. 3 illustrates the decrease in pressure in the armature cavity 39 due to an increase in the total volume of the expansion tanks using various combinations of slots and spacers. The peak armature cavity pressure has been reduced from approximately 225 bar to approximately 110 bar by using a particular combination of two slots on the stator 42.

To transfer pressure into the second expansion tank 49, the spacer 47 could be sized to create a passageway between the valve body 16 and the stator. Slots or pores could also be added to the spacer to act as a passageway. Alternatively, passageways could be formed in either the valve body 16 or the stator 42 to direct pressure into the second expansion tank 49.

The strength of the stator 42 may also be increased due to the expansion tanks 49 equalizing the pressure on the various surfaces of the stator. The equalized pressure applied to the stator 42 puts the stator in compression and further minimizes the likelihood of separation of the molding material and the magnetic core material.

While embodiments of the invention have been illustrated and described, it is not intended that these embodiments illustrate and describe all possible forms of the invention. Rather, the words used in the specification are words of description rather than limitation. It is understood that various changes may be made without departing from the spirit and scope of the invention.

What is claimed is:

1. An electromechanical fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body; and at least one expansion tank in fluid communication with the pump unit to accumulate pressure created by the pump unit;

the expansion tank comprising a plurality of grooves in the stator;

the grooves being surrounded by the stator nut to define a pressure accumulator space for the expansion tank.

2. An electromechanical fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body; and at least one expansion tank in fluid communication with the pump unit to accumulate pressure created by the pump unit;

the expansion tank comprising a plurality of grooves in the stator nut;

the grooves and the stator defining a pressure accumulator space for the expansion tank.

3. An electromechanical fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body; and at least one expansion tank in fluid communication with the pump unit to accumulate pressure created by the pump unit;

at least a portion of the outer circumference of the stator being smaller than at least a portion of the inner circumference of the stator nut;

the expansion tank comprising a space created by a difference between the outer circumference of the stator and the inner circumference of the stator nut.

4. An electromechanical fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body; and at least one expansion tank in fluid communication with the pump unit to accumulate pressure created by the pump unit;

an armature disposed within the valve body, the armature opening and closing the valve element to establish a passageway communicating with the pump unit, whereby pressure generated by the pump unit is dispersed into the expansion tank, a spacer between the armature and the valve body to create a passageway, the expansion tank being partially defined by the passageway; and a second expansion tank located between the stator and the stator nut, the passageway directing pressure to the second expansion tank.

5. A fuel injector for an internal combustion engine, the fuel injector comprising:

a pump unit;

a control valve assembly in communication with the pump unit, the control valve assembly including a valve body and a stator;

a stator nut being cooperable with the valve body to secure the stator to the valve body;

a spacer positioned between the stator and the valve body to create a first expansion tank to accumulate pressure created by the pump unit, the first expansion tank being in fluid communication with the pump unit; and a second expansion tank to accumulate pressure, the second expansion tank being located between the stator and the stator nut and communicating with the pump unit.

6. The fuel injector of claim 5 wherein the first expansion tank and the second expansion tank are in fluid communication whereby the first expansion tank directs pressure from the pump unit to the second expansion tank.

7. A fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body;

a spacer positioned between the stator and the valve body to create a passageway;

an expansion tank located between the stator and the stator nut to accumulate pressure from the pump unit, the expansion tank being in fluid communication with the pump unit via the passageway; and grooves in the stator, the grooves partly defining the expansion tank.

8. A fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body;

a spacer positioned between the stator and the valve body to create a passageway;

an expansion tank located between the stator and the stator nut to accumulate pressure from the pump unit, the expansion tank being in fluid communication with the pump unit via the passageway; and grooves in the stator nut, the grooves partly defining the expansion tank.

9. A fuel injector for an internal combustion engine, the fuel injector comprising:

a pump unit;

a control valve assembly in communication with the pump unit, the control valve assembly including a valve body and a stator;

a stator nut cooperable with the valve body to secure the stator to the valve body;

a spacer positioned between the stator and the valve body to create a passageway; and an expansion tank located between the stator and the stator nut to accumulate pressure from the pump unit, the expansion tank being in fluid communication with the pump unit via the passageway;

at least a portion of the outer circumference of the stator being smaller than at least a portion of the inner circumference of the stator nut, the expansion tank being defined by a space created by the difference between the outer circumference of the stator and the inner circumference of the stator nut.

10. An electromechanical fuel injector for an internal combustion engine, the fuel injector comprising:

a pump unit including a high pressure pumping chamber;

a nozzle assembly;

a high pressure fuel delivery passage connecting the pumping chamber and the nozzle assembly;

a control valve assembly in communication with the pump unit, the control valve assembly including a valve element, a valve body and a stator;

a stator nut cooperable with the valve body to secure the stator to the valve body; and at least one expansion tank located within the stator nut to accumulate pressure created by the pump unit, the expansion tank being in fluid communication with the high pressure pumping chamber during a portion of a fuel injection event.

11. The fuel injector of claim 10 further comprising an armature disposed within the valve body, the armature opening and closing the valve element to establish a passageway communicating with the pumping chamber whereby pressure generated by the pump unit is dispersed into the expansion tank during a portion of a fuel injection event.

12. The fuel injector of claim 11 further comprising a spacer between the armature and the valve body to create a passageway, the expansion tank being partially defined by the passageway.

13. A fuel injector for an internal combustion engine, the fuel injector comprising:

a pump unit including a high pressure pumping chamber;

a nozzle assembly;

a high pressure fuel delivery passage connecting the pumping chamber and the nozzle assembly;

a control valve assembly in communication with the pump unit, the control valve assembly including a body and a stator;

a stator nut cooperable with the body to secure the stator to the body; and a spacer positioned between the stator and the valve body to create a first expansion tank to accumulate pressure created by the pump unit, the expansion tank being in fluid communication with the high pressure pumping chamber during a portion of a fuel injection event.

14. A fuel injector for an internal combustion engine, the fuel injector comprising:

a pump unit including a high pressure pumping chamber;

a nozzle assembly;

a high pressure fuel delivery passage connecting the pumping chamber and the nozzle assembly;

a control valve assembly in communication with the pump unit, the control valve assembly including a valve body and a stator;

a stator nut cooperable with the valve body to secure the stator to the valve body;

a spacer positioned between the stator and the valve body to create a passageway; and an expansion tank located between the stator and the stator nut to accumulate pressure from the pump unit, the expansion tank being in communication with the pump unit via the passageway during a portion of a fuel injection event.

15. The fuel injector of claim 14 wherein the spacer is formed with slots to partly define the passageway.

16. The fuel injector of claim 14 wherein the spacer is porous, thereby partly defining the passageway.

* * * * *